US008528475B2

(12) United States Patent
Lyytinen et al.

(10) Patent No.: US 8,528,475 B2
(45) Date of Patent: Sep. 10, 2013

(54) METHOD AND APPARATUS FOR IMPROVING VENEER QUALITY

(75) Inventors: Harri Lyytinen, Lahti (FI); Jarkko Kaislaoja, Lahti (FI); Andre Klemarewski, North Vancouver (CA)

(73) Assignee: Raute Oyj, Nastola (FI)

( * ) Notice: Subject to any disclaimer, the term of this patent is extended or adjusted under 35 U.S.C. 154(b) by 198 days.

(21) Appl. No.: 13/032,448

(22) Filed: Feb. 22, 2011

(65) Prior Publication Data

US 2011/0232512 A1 Sep. 29, 2011

(30) Foreign Application Priority Data

Feb. 26, 2010 (FI) ..... 20105189

(51) Int. Cl.

| | |
|---|---|
| ***B30B 11/22*** | (2006.01) |
| ***B30B 15/20*** | (2006.01) |
| ***B27M 1/02*** | (2006.01) |

(52) U.S. Cl.

USPC ..... 100/306; 100/151; 100/152; 100/153; 100/307; 100/308; 156/555; 156/580; 156/582; 156/583.5

(58) Field of Classification Search

USPC ..... 100/151, 152, 153, 306, 307, 308; 156/555, 580, 582, 583.5

See application file for complete search history.

(56) References Cited

U.S. PATENT DOCUMENTS

| | | | | |
|---|---|---|---|---|
| 3,057,075 | A * | 10/1962 | Lippke | 34/246 |
| 4,001,074 | A | 1/1977 | Pagnoni | |
| 5,560,410 | A * | 10/1996 | Peacock | 144/362 |
| 6,287,410 | B1 * | 9/2001 | Klemarewski | 156/273.7 |
| 6,435,247 | B1 * | 8/2002 | Kerr | 156/555 |
| 6,659,152 | B1 * | 12/2003 | Miyake | 156/555 |
| 7,997,314 | B2 * | 8/2011 | Becker-Weimann et al. | 144/332 |
| 2001/0042452 | A1 * | 11/2001 | Hirose et al. | 100/151 |
| 2003/0213380 | A1 * | 11/2003 | Sebastian et al. | 100/151 |

FOREIGN PATENT DOCUMENTS

| | | | |
|---|---|---|---|
| GB | 159204 | A | 5/1922 |
| JP | 10-57552 | A | 3/1998 |

OTHER PUBLICATIONS

Hagan, Edward and Dietz, Karl. Dupont Dry Film Lamination Process: Effects of Lamination Parameters on Wrinkling and Dimensional Properties of Dry Film and Copper-Cladd Laminate. Dupont Photoploymner and Electronic Materials. Research Traingle Park, NC. Apr. 7, 2009.*

* cited by examiner

*Primary Examiner* — Dana Ross
*Assistant Examiner* — Onekki Jolly
(74) *Attorney, Agent, or Firm* — Womble Carlyle Sandridge & Rice, LLP

(57) ABSTRACT

A method and apparatus for improving of wood veneer quality is provided. In the method, veneers are conveyed through a compression gap made up by two press elements, the gauge of said gap being adjustable. The method comprises the use of an endless felt assembly, which is adapted to circle around at least one of the press elements and which passes through the compression gap in such a way that at least one face of the veneer is brought against the felt assembly in said compression gap.

3 Claims, 1 Drawing Sheet

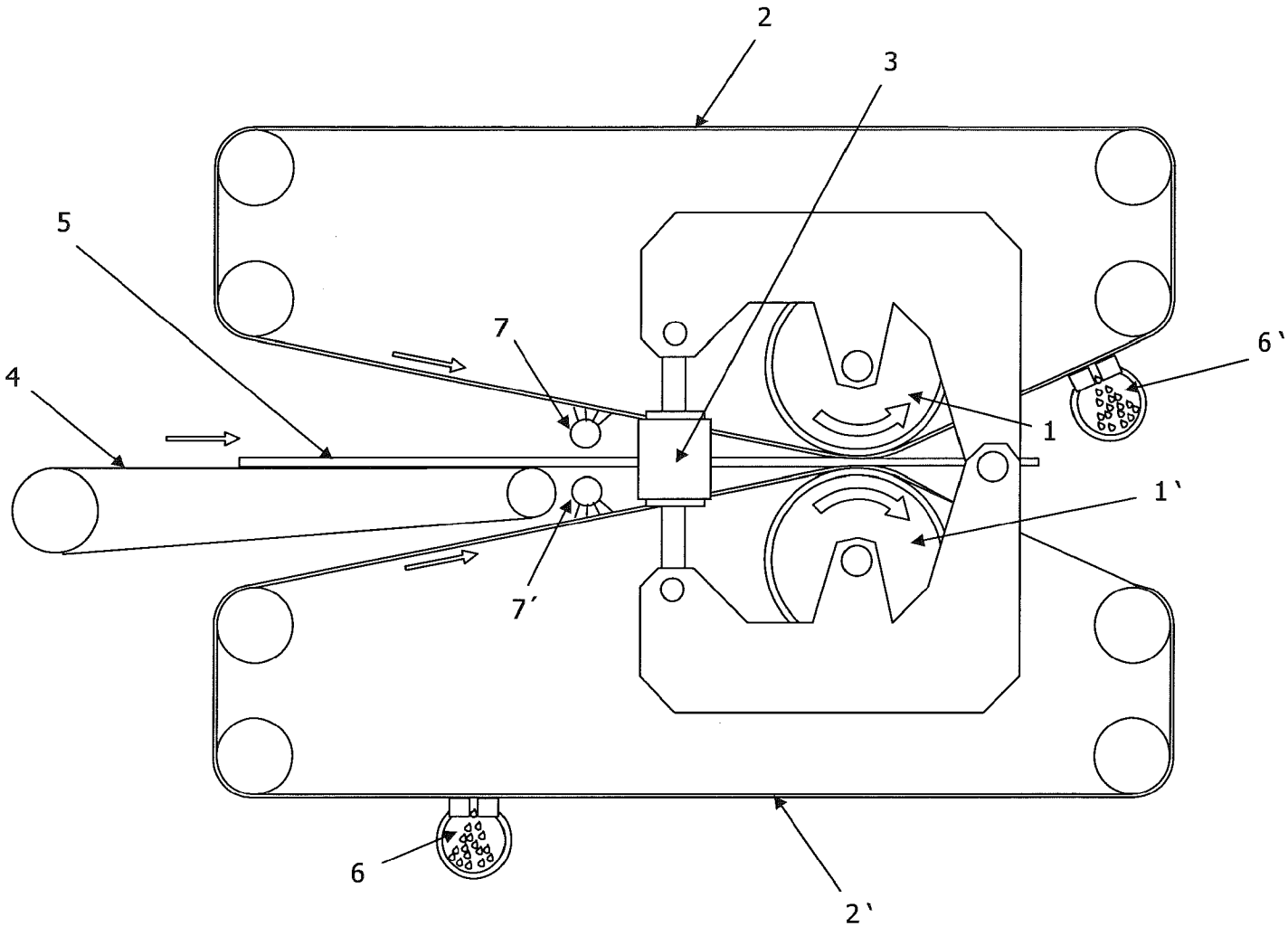
6'
1'
1
3
2
2'
7
7'
6
5
4

METHOD AND APPARATUS FOR IMPROVING VENEER QUALITY

CROSS-REFERENCE TO RELATED APPLICATION

This application claims priority from and the benefit under 35 U.S.C. §119 of Finnish Patent Application No. 20105189, filed Feb. 26, 2010 in the Finnish Patent Office, which is hereby incorporated herein by reference in its entirety.

BACKGROUND OF THE DISCLOSURE

1. Field of the Disclosure

The present invention relates to a method and an apparatus for improving wood veneer quality and thereby improving also qualities of products to be manufactured from the veneers.

2. Description of Related Art

After being cut veneer sheets are usually treated in various drying processes, after which the dried veneers can be assembled together e.g. for plywood panels. Veneers can also be used for many other purposes, such as e.g. as a bottom veneer in parquet floors. One problem in the process of assembling veneer sheets e.g. for panel structures is that the compression force required in a panel structure gluing process is relative high, e.g. 12 bars, and the treatment times can be quite long, e.g. 15 to 45 minutes, the final thickness of a panel structure being reduced typically by about 8%. These requirements are mainly due to variations in veneer roughness and/or thickness.

BRIEF SUMMARY OF THE DISCLOSURE

A goal of the present invention is to provide a method which enables veneers to be treated in a way to improve their qualities, such as e.g. surface roughness, uniformity of moisture content, etc. In order to reach this goal, a method of the invention is characterized in that veneers are conveyed through a compression gap made up by two press elements, the gauge of said gap being adjustable, and that the method comprises the use of an endless felt assembly, which is adapted to circle around at least one of the press elements and which passes through the compression gap in such a way that at least one face of the veneer is brought against the felt assembly in said compression gap. An apparatus of the invention is characterized in that it features a compression gap made up by two press elements, the gauge of said gap being adjustable, and an endless felt assembly, which is adapted to circle around at least one of the press elements and which passes through the compression gap in such a way that at least one face of the veneer is brought against the felt assembly in said compression gap.

The press elements are preferably constituted by rolls having smooth surfaces and the felt assembly is preferably adapted to circle around each roll in such a way that both faces of the veneer are brought to a compression contact with the felt.

The solution according to the invention improves the qualities of a veneer sheet. For example, the surface quality (roughness) can be improved in such a way that in subsequent treatment processes, such as in the process of producing a plywood panel by gluing, the required amount of adhesive can be reduced and, in addition, the compression pressure can be lower, e.g. in the order of 6 bars, and, due to this reduction in compression pressure, the compression shrinkage in the plywood panel can be decreased e.g. from 8% to 4%. This, in turn, reduces the amount of sanding normally involved in plywood panel production and, in some cases, the sanding can be completely eliminated, e.g. in the case of subsequently coated plywood panels.

It can be confirmed on the basis of tests that the thickness deviation of veneers is substantially reduced during the treatment. Likewise, the thickness deviation of panels made from veneers pretreated with an apparatus of the invention is lesser than what is found in veneers dried by traditional hot air drying.

The thickness deviation can be influenced by means of apparatus control. If the apparatus is controlled by setting a certain minimum value for the roll gap, after which the compression pressure starts taking effect, the thicker veneers will be subjected to a pressure higher than that applied to thinner veneers, resulting in the reduction of thickness deviation. It is also possible to set the gap to a certain fixed value, whereby thicker veneers become considerably more compressed than thinner ones, thus resulting in a reduced deviation.

Removing of free water and the thickness change of veneers can be influenced directly by means of the applied compression pressure. When dealing with veneers of lower density, it is also beneficial to employ a lower compression pressure in order to avoid excessive compression of veneers. Indeed, the applied pressure must be optimized individually in each case for optimal dewatering, yet without compressing the veneer too much.

The amount of de-watering and moisture equalization can be improved by heating veneers before processing through rollers and felt machine. Veneers should be heated to 30-70° C. Heating could be accomplished by Infrared radiation or dielectric heating (Radio Frequency or Microwave). Higher temperature improves elasticity of wood cell wall and allows for higher compression rate during processing without cell wall damage. Water viscosity drops as its temperature increases, so the amount of squeezed water increases.

The method and the apparatus provide also an opportunity to increase the density of a veneer, i.e. to densify the veneers. The regulation of compression can be used for influencing the degree of densification and thereby making a difference in the properties of a veneer and making it as desired for subsequent process operations. If more de-watering or higher veneer densification is desired, there could be a series of roller pairs arranged in line. Each pair could have a gap adjusted progressively smaller.

The use of wood species having a very low density and/or having an otherwise fragile composition is difficult in the normal process, because the veneer sheets are easily shattered in handling. Densification enables the use of these wood species, because a brittle veneer can be made denser and more consistent by compression while drying the veneer at the same time.

The method according to the invention improves the efficiency of a veneer drying process with respect to hot air drying, resulting in a significant saving of energy in drying. Evaporation of water consumes considerably more energy than mechanical removal. In compression drying, the amount of energy required by a veneer drying machine per cubic meter of dried veneer is substantially reduced, as well as enables increasing the capacity of a dryer as a result of a shorter drying time, which provides a major saving for the factory.

The equalization of moisture within a veneer sheet by using the pretreatment method and apparatus of the present invention provides also for easier adjustment of the proper dryer. The more uniform initial moisture in the process of feeding material to the dryer results in the fact that making the final moisture more consistent becomes easier as well and thereby the overdrying of veneers can be avoided and higher quality veneer can be obtained for use in the end process. By virtue of a lesser final moisture deviation in veneers, the average final moisture can be increased. This enables a further reduction of quality losses inflicted by drying and at the same time a saving of drying energy.

With a reduction in the moisture and moisture deviation of veneers, it is possible to conduct a post-treatment moisture grading and a density grading at the same time according to dry basis weight. These both make a contribution to the drying of a veneer in a veneer drying machine, whereby, when using graded veneers, the dryer can be adjusted more precisely for various grades of moisture/density.

BRIEF DESCRIPTION OF THE SEVERAL VIEWS OF THE DRAWING(S)

The invention will now be described more closely with reference to the accompanying drawing, FIG. 1, of which shows in a schematic sketch one apparatus embodiment used for practicing the method of the invention.

DETAILED DESCRIPTION OF THE DISCLOSURE

The press mechanism, which is depicted in the figure just by way of example, comprises press rolls 1, 1' and an endless felt loop 2, 2' adapted to circle around the same. The compression gap or nip between the press rolls is adjustable preferably by means of a hydraulic or mechanical actuator 3. Instead of press rolls, the press elements can be provided e.g. in the form of an arcuate- or flat-surface press bar or the like elements. The actuator 3 can be e.g. electrically operated or pneumatic. The apparatus can be controlled e.g. in such a manner that a certain minimum value has been set for the roll gap, after which the compression pressure applied by the rolls to the veneers starts taking effect. Hence, the thicker veneers will be subjected to a pressure higher than that applied to thinner veneers, resulting in the reduction of thickness deviation. The compression gap may also be completely pressure controlled. The gap can also be adjusted to some specific fixed value according to the thickness grade of veneers. Thus, thicker veneers are compressed considerably more than thinner ones, resulting in a reduced deviation. Preferably the method comprises adjusting the gauge of the gap and/or pressure prevailing in the gap such that the veneer sheet be subjected to a lower compression at its entry end and at its rear end than in its middle part in order to avoid excessive drying of the end regions in the following drying step(s).

In this context, the term "adjustment" is intended to cover also the placement of rolls in certain optional fixed locations, which each time determine a certain gauge for the roll gap. The apparatus is preferably provided with a felt moistening device 7, 7', as well as with a felt drying device 6, 6', by means of which the felt moisture can be adjusted as desired. The moist felt employed in a method of the invention equalizes moisture variations in a veneer 5 brought to the press apparatus e.g. on a conveyor belt 4, by removing water from more moist spots and delivering it to respectively drier spots. The felt's moisture content can be determined experimentally based on the properties and inlet moistures of various veneer grades. The felt's thickness is preferably equal to that of a currently treated veneer, but it can also be considerably thicker, especially when a powerful demoisturizing capability is required. In some cases, it can also be thinner than the veneer thickness. Tests have revealed that the use of such a moist felt does not instigate the disruption of knot spots as opposed to pressing a veneer e.g. between two hard surface rolls or between rolls with elastic coatings or belt loops. Tests have further revealed that lathe checks in veneers, inflicted by veneer peeling, will be at least partially closed by means of felt pressing, resulting in a smoother surface quality. In principle, the felt may also be essentially dry prior to passing into the compression gap, in which case it moistens as a result of moisture transferred to said felt from veneers. However, it has been found experimentally that a felt composition, which has been prepared by adjusting it to certain moisture content, is more effective in terms of absorbing moisture from veneers and better than a substantially dry felt composition in terms of equalizing moisture variations between various segments of a veneer.

Higher-quality veneers provide an upgrading effect for products manufactured therefrom, e.g. improving the thickness tolerance of plywood panels and reducing the amount of adhesive used therefore since smoother veneers require less adhesive. In addition, it is even possible in certain products to completely eliminate the sanding normally involved in the process. The method enables providing not only an improvement of quality but also a distinctive cost saving, particularly as a result of the diminished demand of energy spent for drying.

The apparatus preferably includes a cleaning mechanism, for example water/lye washing equipment or a brushing mechanism for the removal of debris and/or pitch.

In a test run for a method of the invention, it was discovered that, e.g. with a 5 mm roll gap, the average moisture content had fallen from an initial moisture value of 159.8% to a final moisture value of 127.8%, while the deviation had fallen from 33.2% to 21.3%. With a 4.5 mm roll gap, the respective changes in averages were initial moisture 159.9%, final moisture 96.4%, and in deviation from 30.6% to 13.1%. These test results are merely guiding values with no intention to limit the scope of protection for the invention.

That which is claimed:

1. A method for improving wood veneer quality, comprising conveying a veneer through a compression gap defined by two press elements, a gauge of said gap being adjustable, and at least one of the press elements having an endless felt assembly circled therearound such that the felt assembly passes through the compression gap with at least one face of the veneer being brought against the felt assembly in said compression gap; moistening the felt assembly by one of transferring moisture from the veneer to the felt assembly, and adjusting moisture content in the felt assembly using a moisture adjustment arrangement having one of a moistening device and a drying device; and equalizing moisture content of the veneer conveyed through the compression gap with the moistened felt assembly.

2. A method as set forth in claim 1, wherein at least one of the press elements is a roll.

3. A method as set forth in claim 1, comprising adjusting one of the gauge of the gap and a pressure in the gap such that the veneer is subjected to a lower compression at an entry end and at a rear end of the gap than in a middle part of the gap in order to avoid excessive drying of end regions of the veneer in a following drying step.

* * * * *